United States Patent [19]

Crowe et al.

[11] Patent Number: 4,699,533

[45] Date of Patent: Oct. 13, 1987

[54] SURFACE LAYER TO REDUCE CONTACT RESISTANCE IN RESISTIVE PRINTING RIBBON

[75] Inventors: Jesse R. Crowe; Derek B. Dove, both of Mt. Kisco; Kwang K. Shih, Yorktown Heights, all of N.Y.

[73] Assignee: International Business Machines Corporation, Armonk, N.Y.

[21] Appl. No.: 806,892

[22] Filed: Dec. 9, 1985

[51] Int. Cl.[4] ..... B41D 31/00

[52] U.S. Cl. ..... 400/241.1; 400/120; 428/913; 428/914; 346/76 R

[58] Field of Search ..... 400/120, 241.1; 428/913, 914; 346/76 R, 76 L

[56] References Cited

U.S. PATENT DOCUMENTS

| | | | |
|---|---|---|---|
| 4,103,066 | 7/1978 | Brooks et al. | 400/241.1 X |
| 4,309,117 | 1/1982 | Chang et al. | 400/241.1 |
| 4,320,170 | 3/1982 | Findlay | 400/120 X |
| 4,453,839 | 6/1984 | Findlay et al. | 400/120 |
| 4,461,586 | 7/1984 | Kawanishi et al. | 400/120 |
| 4,477,198 | 10/1984 | Bowlds et al. | 400/120 |
| 4,491,431 | 1/1985 | Aviram et al. | 400/241.1 |
| 4,536,437 | 8/1985 | Kawanishi et al. | 400/120 X |

FOREIGN PATENT DOCUMENTS

| | | | |
|---|---|---|---|
| 0113018 | 7/1984 | European Pat. Off. | 400/241.1 |

OTHER PUBLICATIONS

IBM Technical Disclosure Bulletin, "Reactive Evaporation or Sputtering of Metal-Metal Oxide Printing Film Ribbon", Aviram et al, vol. 25, No. 12, May 1983, p. 6391.

IBM Technical Disclosure Bulletin, "Reduction of Contact Resistance in Resistive Ribbon Printing", vol. 28, No. 7, Dec. 1985, pp. 2977–2978.

Thin Solid Films, 108 (1983), pp. 229–238, "The Development of High Performance, Low Cost Solar-Selective Absorbers", Sikkens et al.

Journal of Vacuum Science Technology, "Physical Vapor Deposition of Thick CR and its Carbide and Nitride Films by Hollow-Cathode Discharge", Komiya et al, vol. 13, No. 1, Jan./Feb. 1976, pp. 520–524.

SID Symposium 4/29–5/3/85, Orlando, Fla., "Thermal Characterization of Resistive Ribbon Printing", O. Sahni, et al.

IBM TDB, vol. 25, No. 7a, 12/82 "Graphite-Resin Lamination on Thermal Ribbon" by H. Findlay et al, p. 3194.

IBM TDB, vol. 25, No. 7a, 12/82 "Embedded Graphite Lamination on Thermal Ribbon" by H. Findlay et al, p. 3193.

*Primary Examiner*—Ernest T. Wright, Jr.

*Attorney, Agent, or Firm*—Jackson E. Stanland

[57] ABSTRACT

An improved resistive ribbon for thermal transfer priting in which a coating is located on the resistive layer in order to reduce contact resistance between the ribbon and printhead, thereby reducing undesirable heating at the contact region between the ribbon and printhead. The coating is comprised of compositions selected from the group consisting of Cr-N, Sn-SnO, ITO, AlN and Al-$Al_2O_3$, where the resistivity of the coating is significantly less than the resistivity of the resistive layer of the ribbon. Further, the sheet resistivity of the coating is greater than the sheet resistivity of the resistive layer. The rest of the resistive ribbon can be comprised of any combination of the usually employed layers, such as a current return layer, a release layer for facilitating the transfer of ink from the ribbon to a carrier, and the ink layer itself.

15 Claims, 7 Drawing Figures

SURFACE LAYER TO REDUCE CONTACT RESISTANCE IN RESISTIVE PRINTING RIBBON

TECHNICAL FIELD

This invention relates to an improved resistive ribbon for resistive ribbon thermal transfer printing, and more particularly to such a ribbon having an improved surface layer designed to reduce contact resistance and to provide higher quality printing.

BACKGROUND ART

Resistive ribbon thermal transfer printing is well known in the art as a type of nonimpact printing. Printing is effected by the flow of a melted material (ink) from a transfer medium to a recording medium, such as paper. A ribbon is used having a resistive layer, a metal (Al) current return layer, and an ink layer. In some ribbons, an ink release layer is located between the metal layer and the ink layer in order to facilitate the transfer of ink from the ribbon to the paper. In operation, electrical currents flow from printing electrodes into the resistive layer to a thin Al current return layer. This flow of current causes localized heating which melts the ink, allowing it to transfer to the paper which contacts the ink layer. High quality printing of the type used for computer terminal applications and typewriters is thereby possible.

To accomplish high quality printing, many factors have to be present in the performance of these ribbons. One factor is the response of the resistive layer to the applied current, with respect to the current required for adequate heating and with respect to the avoidance and degradation of the ribbon or printhead from the effects of heating and current flow. To accomplish the required printing, the resistivity and other properties of the resistive layer are carefully controlled during fabrication.

In general, a contact resistance exists between the sliding printing electrodes and the resistive ribbon, due to imperfect contact between these members. Some proportion of the power supplied to the ribbon is dissipated by this contact resistance, resulting in heating of the print head and causing undesired wear and other consequences as well as inefficient use of energy. Further, there tends to be abrasive wear of the hot electrodes as they slide across the ribbon surface. It is therefore advantageous to have low contact resistance so that heating of the surface of the ribbon and the head is minimal, a factor which is especially important for high speed printing in which higher print currents are generally employed.

Contact resistance may be reduced by coating the top surface of the ribbon with a highly conductive material, as illustrated in the following references: U.S. Pat. Nos. 4,309,117; 4,453,839; 4,477,198; and IBM Technical Disclosure Bulletins, appearing in Vol. 25, No. 7A, December 1982, at pages 3193 and 3194. In the first of these listed patents a two-ply resistive layer has a top-ply consisting of a low resistance material and a bottom-ply of high resistance material. The other cited patents and the Technical Disclosure Bulletins generally describe various embodiments using graphite for reduction of contact resistance. In U.S. Pat. No. 4,453,839 the resistive layer includes a light dusting of graphite while in U.S. Pat. No. 4,477,198 the resistive ribbon has a more extensive coating of graphite powder on one side of the resistive layer. The graphite powder provides lubrication and enhanced electrical current-flow parameters.

The Technical Disclosure Bulletins describe resistive ribbons for thermal transfer printing which utilizes either a graphite-resin layer or an embedded graphite layer to improve the current-flow characteristics of the ribbon. In particular, the printing current requirements are reduced and their build-up of free graphite on the printhead is avoided, as is the transfer of graphite to the ink layer. The graphite also appears to reduce frictional wear on the printhead.

Although the technology has recognized that contact resistance may be reduced by coating the top surface of the ribbon with a highly conductive material, such solutions may be unsatisfactory due to the spreading of current from the printing electrodes. Thus, while a more conductive layer is required to reduce contact resistance, the resistivity of this layer may be so low that printing current spreads in the layer and thereby causes a loss in print resolution. In order to lower contact resistance and also to reduce spreading of the current, the coating layer must have a resistivity lower than that of the resistive layer in the ribbon. In addition, the sheet resistivity of the coating layer must be much higher than the sheet resistivity of the resistive layer in the ribbon. This means that the thickness of the coating material must be below a certain limit, which is determined in accordance with the materials used for both the coating layer and the resistive layer in the ribbon.

The considerations described hereinabove with respect to resistivity and sheet resistivity have been recognized herein as being critical to the provision of a suitable layer for reducing contact resistance. The selection of a material to satisfy these properties and yet be readily fabricated as a thin layer having a sufficient degree of flexibility to be wound on a ribbonbearing reel is not readily apparent. Further, while the contact layer should lower the power required for printing and reduce heating of the printhead, it must be a material which is extremely stable so as to have long shelf life, and in addition must be stable during the actual printing operation. This means that it must not be readily corrodible and that it won't be damaged, as by erosion, during printing. Still further, the contact resistance-reducing layer must adhere well to the resistive layer and be sufficiently thin that the total printing capacity of the ribbon is not substantially reduced.

As noted, both sheet resistivity and bulk resistivity must be within certain ranges in order to provide effective contact resistance layers without impairing the printing operation. With materials such as graphite, it is very difficult to control the thickness and uniformity of the coating. Additionally, with metallic materials such as Cu, the conductivity is so high that the materials must be produced as extremely thin coatings. This in turn provides conductive films which are easily eroded during printing and which are subject to corrosion. Thus, with the materials used as contact resistance coatings in the prior art, there is inadequate control of the reproducibility of resistivity and thickness. This coupled with the often difficult fabrication processes and the inadequate electrical properties of the entire ribbon including the coating, has limited use of these prior coatings.

Accordingly, it is an object of this invention to provide an improved coating for reducing the contact resistance of a resistive ribbon used for thermal transfer printing.

It is another object of this invention to provide an improved resistive printing ribbon having a coating thereon for reducing contact resistance, where the coating can be easily fabricated with an appropriate resistivity and thickness.

It is another object of this invention to provide an improved resistive printing ribbon having a coating thereon for reduction of contact resistance, the coating being stable during ribbon storage and during actual printing operations, said coating adhering well to the resistive layer in the ribbon.

It is another object of the present invention to provide an improved coating for reducing contact resistance in a resistive printing ribbon, where the coating can be sufficiently thin that the total printing capacity of the ribbon is not substantially reduced.

It is another object of the present invention to provide an improved resistive ribbon for thermal transfer printing having a coating thereon which reduces contact resistance, where the coating can be made to have a very smooth surface.

DISCLOSURE OF THE INVENTION

In the practice of this invention, an improved resistive printing ribbon is provided having a coating thereon for reduction of contact resistance and for providing improved print quality. This coating is located on the resistive layer surface that is contacted by the printing electrodes. The resistive ribbons of this invention include as a minimum the contact resistance-reducing coating, a resistive layer through which current flows for localized heating, and a marking layer (ink). The material in the marking layer is capable of being melted by heat generated due to current flow in the resistive layer so that it can be transferred. Of course, the ribbon can include additional layers, such as a thin conductive layer used as a current return layer, and an ink-release layer to facilitate release of ink from the ribbon to the carrier on which printing is to occur.

The improved coating materials of this invention are generally applied to the surface of the resistive layer remote from the marking layer (ink) and have particular electrical properties with respect to the electrical properties of the resistive layer. In order to reduce contact resistance, the resistivity $\rho_c$ of the coating layer is less than the resistivity $\rho_R$ of the resistive layer, where these resistivities can be measured in, for instance, ohm-cm. Further, in order to minimize current spreading due to the presence of the coating, the sheet resistivity $\rho_{sc}$ of the coating layer is greater than the sheet resistivity $\rho_{sR}$ of the resistive layer, where this quantity is measured in, for instance, ohms/sq. Another way to express this latter requirement is by the following expression:

$$\rho_c/t_c > \rho_R/t_R \text{ where } \rho_c < \rho_R,$$

and where $t_c$ is the thickness of the coating and $t_R$ is the thickness of the resistive layer.

The improved coating materials of the present invention are Cr-N, Sn-SnO, ITO (indium tin oxide), Al-N, and Al-$Al_2O_3$. These materials can be easily deposited on conventional resistive layers by known techniques, such as RF or DC sputtering, or by evaporation. By varying parameters such as $N_2$ or $O_2$ pressure, coatings of the desired thickness can be obtained in the desired resistivity ranges.

The other layers of the ribbon can be comprised of materials which are generally known for these purposes. For example, the resistive layer can be a carbon-loaded polycarbonate layer etc. of a type well known in the art, while the conductive current return layer is preferably a thin Al layer. Many types of ink-release layers and ink layers are known in the art, as can be seen by referring to, for instance, U.S. Pat. No. 4,453,839. The composition of these various layers and their relative thicknesses are chosen in accordance with design requirements, as is well known in the art, and do not form a critical part of the present invention.

These and other objects, features, and advantages will be apparent from the following more particular description of the preferred embodiments.

BEST MODE FOR CARRYING OUT THE INVENTION

In the practice of this invention, it has been found that coatings comprised of Cr-N, Sn-$SnO_X$, ITO, Al-N and Al-$Al_2O_3$ provide very suitable coatings to reduce contact resistance without unwanted current spreading. Coating layers of these materials can be produced with the proper values of resistivity and thickness in order to achieve these goals. Still further, these materials have resistivities which are easy to control during deposition and the coatings are stable and not eroded during printing. The smoothness of the coating material is excellent and therefore reduces abrasive wear of the print head due to sliding contact with the resistive ribbon.

The print qualities using resistive ribbons with and without these improved coatings have been compared. While the printing quality of coated and uncoated ribbons is approximately equal at high printing currents, improved print quality is obtained with coated ribbons at lower currents. This improvement in print quality is quite visible, and was a surprising result since the total printing power was reduced when the coating was used.

It has been discovered that improved coatings using these materials can be obtained with different resistivities and thicknesses consistent with manufacturing ease and operability during storage and printing operations. This means that a large range of resistivities and thicknesses can be provided to accomodate ribbons having different designs. Thus, while examples of the use of such coatings will be described hereinafter, it will be apparent to those of skill in the art that the data mentioned in these examples is for a ribbon having well known thicknesses and resistivities. Such a ribbon can be comprised of a carbon-loaded polycarbonate layer of approximately 17 microns thickness and having a resistivity of about 0.5–1 ohm-cm. An aluminum current return layer having a thickness of about 1000 Angstroms is used, while the ink layer has a thickness of approximately 4–6 microns. For these ribbons, a coating layer to reduce contact resistance typically has a thickness less than 1 micron, and preferably about 500–1000 Angstroms. The sheet resistivity of such a layer is generally in the range of about 1000–4000 ohms/sq. and preferably about 2000–3000 ohms/sq., while the resistivity is in the order of about $10^{-2}$ ohms-cm.

Figure 1:
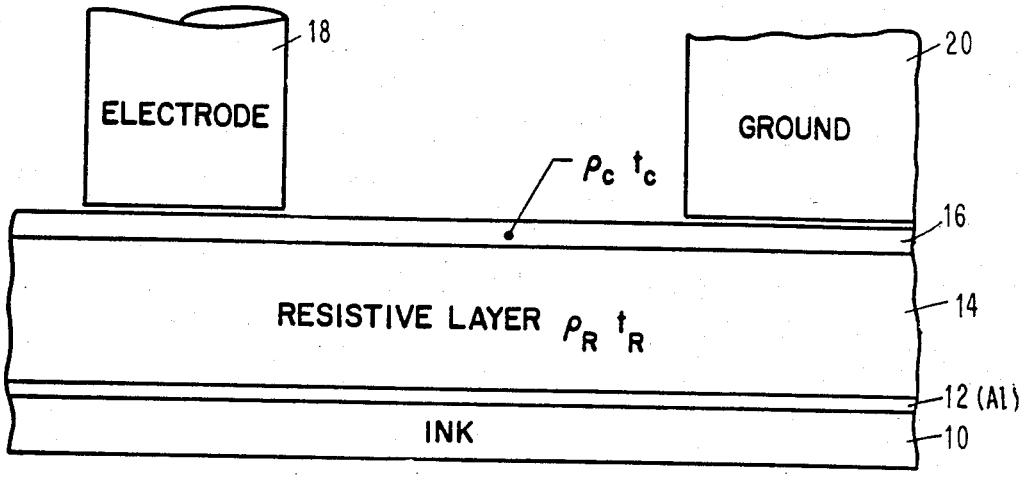
FIG. 1 schematically illustrates a resistive printing ribbon in accordance with the present invention in which an improved coating for reducing contact resistance is located on the side of the resistive layer opposite to the side on which the ink layer is located.

FIG. 1 schematically illustrates a resistive printing ribbon in accordance with the present invention, where the printing ribbon includes an ink layer 10, an aluminum current return layer 12, a resistive layer 14, and the coating 16 for reduction of contact resistance. The resistivity and thickness of the resistive layer 14 are denoted $\rho_R$ and $t_R$, while the resistivity and thickness of the coating are denoted by $\rho_c$ and $t_c$. A printing electrode 18 is shown, as is a portion of the grounded broad area, current return electrode 20.

During printing, current from electrode 18 passes through the coating 16 and the resistive layer 14, and returns via aluminum layer 12 to the ground electrode 20. Localized heating by current flow through the resistive layer 14 causes localized melting of the ink layer 10 for transfer to a carrier, such as paper.

The coating materials of the present invention include Cr-N, Sn-SnO, ITO, Al-N and Al-$Al_2O_3$. These materials satisfy the two following criteria at reasonable values of thickness:

$$\rho_c < \rho_R \quad (1)$$

$$\rho_{sc} > \rho_{sR}, \text{ i.e.,} \quad (2)$$

$$\rho_c/t_c > \rho_R/t_R$$

The first condition ensures that a low current resistance will be realized, while the second condition ensures that adverse current spreading will not occur.

Both of these conditions are satisfied in coating layers having thickness significantly less than 1 micron, and preferably in the thickness range of about 500–2000 Angstroms.

Figure 2:
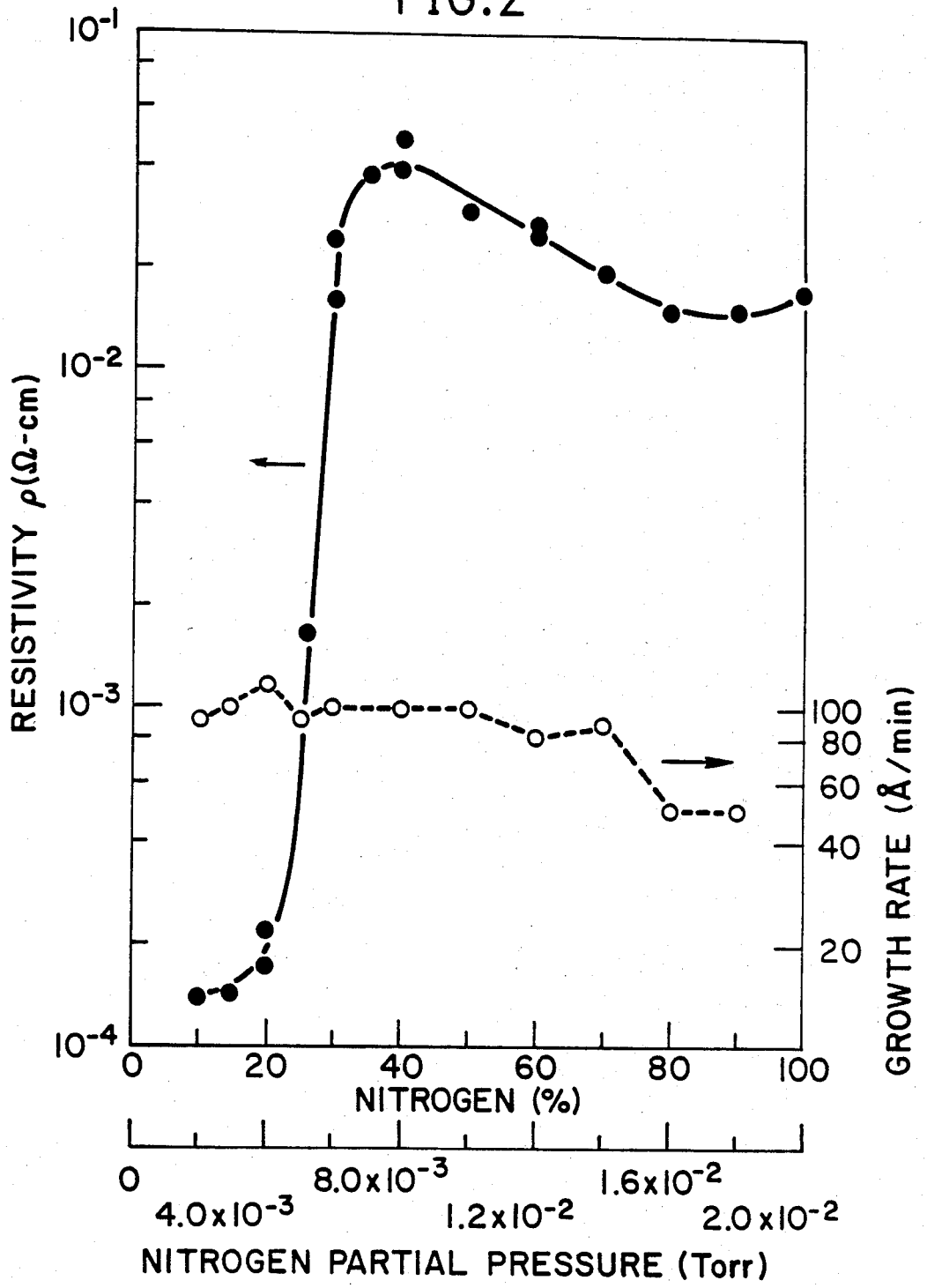
FIG. 2 is a plot of the resistivity and growth rate of a Cr-N coating for reduction of contact resistance, as a function of nitrogen content and nitrogen partial pressure, where the Cr-N coating was deposited by reactive sputtering using a nitrogen-argon gas mixture.

FIG. 2 is a plot of resistivity $\rho$ and growth rate for sputtered Cr-N films, plotted as a function of nitrogen content and nitrogen partial pressure in the sputtering gas mixture. These films were deposited on a resistive layer of a thermal transfer ribbon in a reactive sputtering system in which the target was Cr and sputtering occurred in a chamber including a nitrogen-argon gas mixture. In this sputtering apparatus, Cr and $N_2$ combined at the resistive layer substrate to produce the film of Cr-N. In addition to reactive sputtering, reactive evaporation can also be used.

As is apparent from FIG. 2, the growth rate of the Cr-N films is almost constant with nitrogen content. This allows films of the desired thickness to be easily and reproducibly grown. Further, the resistivity of these films is easy to control and very reproducible after several runs using the same nitrogen content.

Figure 3:
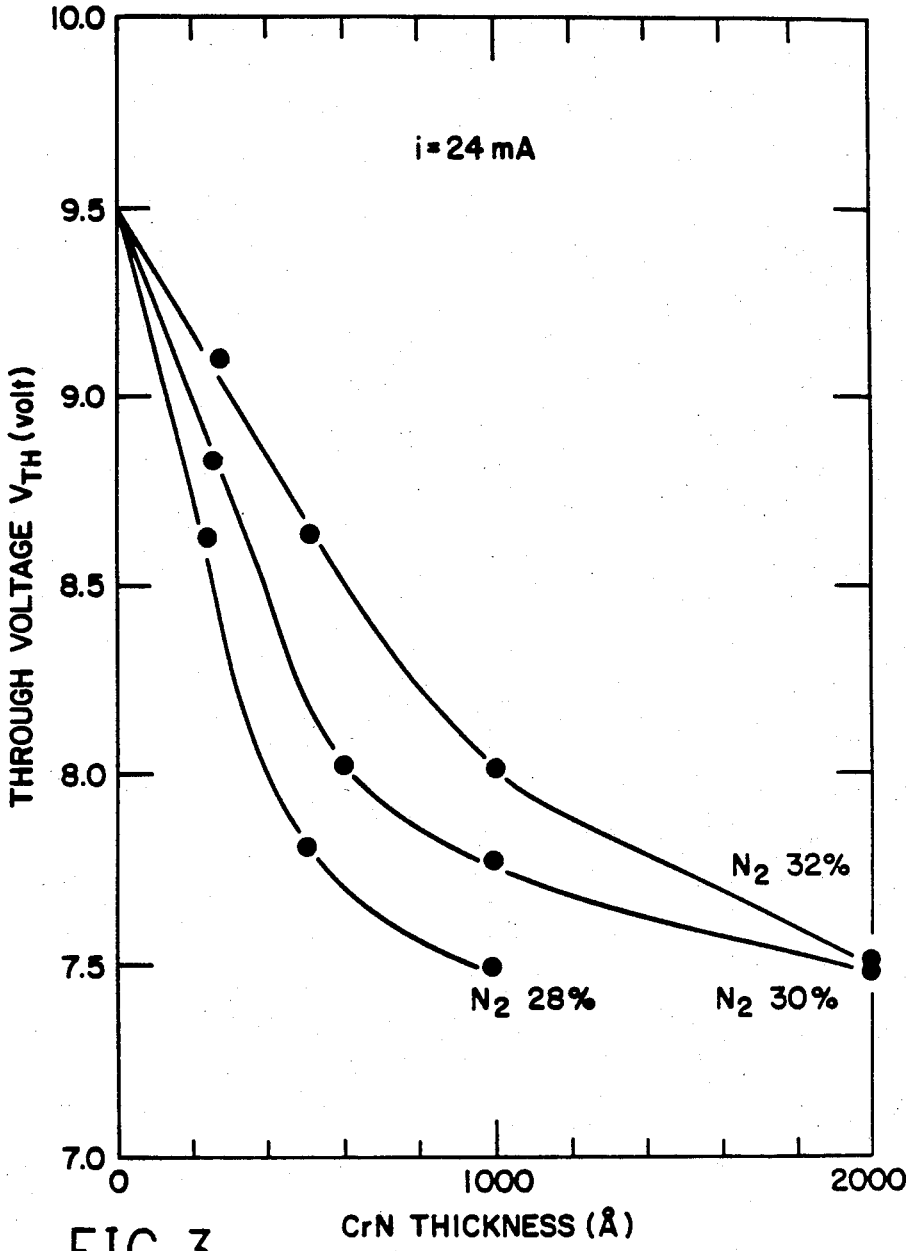
FIG. 3 is a plot of through voltage $V_{TH}$ as a function of thickness for a coating of Cr-N, the through voltage being plotted for three values of nitrogen content in the Cr-N coating. The through voltage is a voltage drop across the entire ribbon for a fixed printing current.

FIG. 3 is a plot of the through voltage $V_{TH}$ as a function of thickness of a Cr-N coating, for three values of nitrogen content. These coatings were deposited on the surface of a regular polycarbonate ribbon using different nitrogen content to control the resistivity of the coatings. The nitrogen contents 28%, 30%, and 32% produced films having resistivity values of about 0.0006, 0.016, and 0.032 ohm-cm, respectively. The thickness of the films was varied from about 250 Angstroms to about 4000 Angstroms.

Printing experiments were then run at different currents. During the printing experiments, the voltage drop across the ribbon (through voltage) at different currents was measured, since this measurement of the difference of through voltage is also a good measurement of the change of contact resistance. For reference, a ribbon without the Cr-N coating was used.

The through voltage versus thickness for different nitrogen content, measured at a printing current of 24 mA, is plotted in FIG. 3. A reduction of through voltage was observed during the printing experiments on all samples coated with Cr-N. As indicated in this plot, the through voltage decreases with increasing Cr-N thickness, and the slope of the voltage drop is steeper for lower resistivity films (i.e., lower N content), as expected. For thick (2000–4000 Angstroms) films, through voltage reduced from 9.5 V to about 6.5 V, but the optical density of printing was also reduced.

Figure 4:
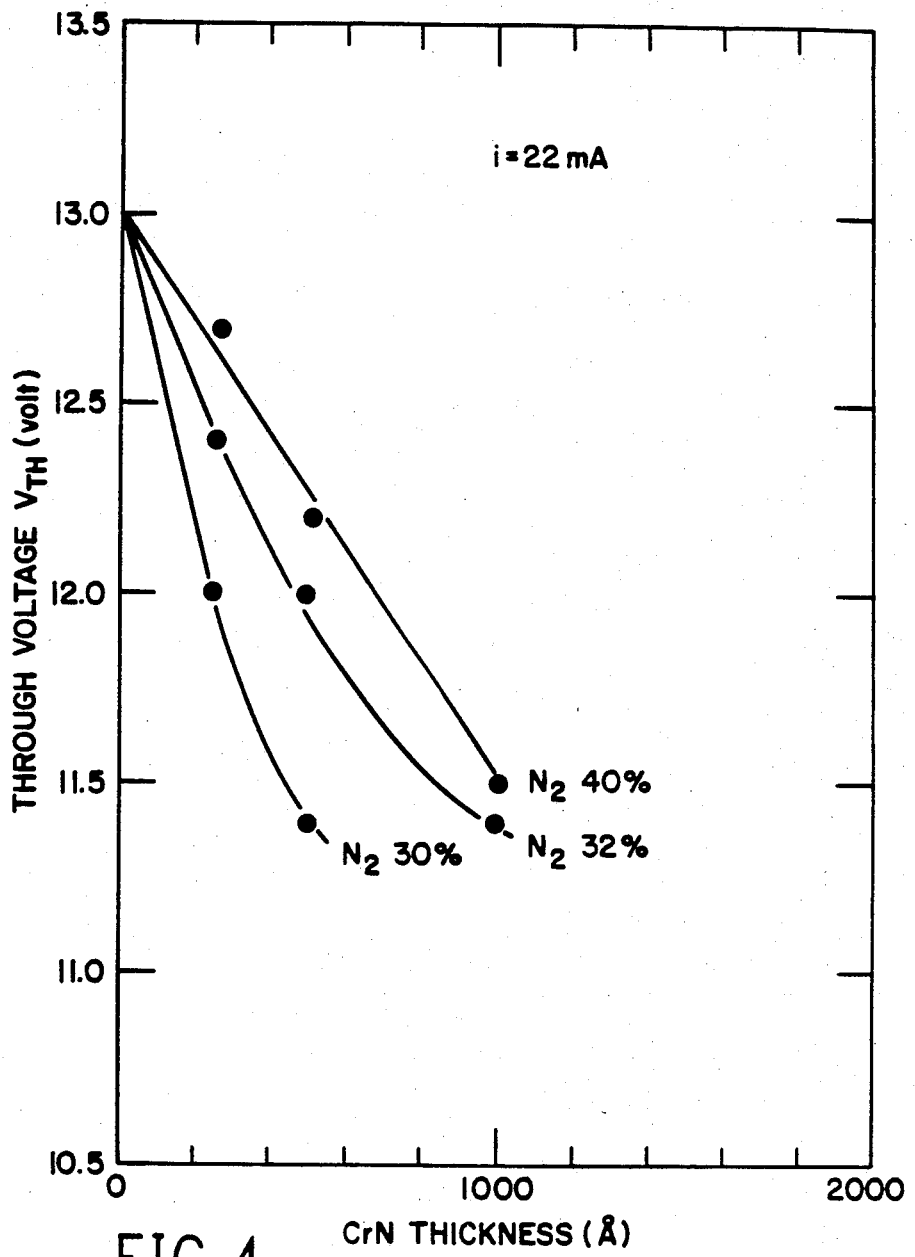
FIG. 4 is a plot of through voltage versus thickness of a Cr-N coating layer to reduce contact resistance, for three values of nitrogen content. The resistivity of the resistive layer in the ribbon of FIG. 4 was higher than that of the resistive layer of the ribbon of FIG. 3, but the experiments to develop the curves in FIGS. 3 and 4 were substantially identical.

Similar experiments were applied to a high resistivity ribbon having a sheet resistivity of about 1850 ohms per square, the results for which are indicated in FIG. 4. The results shown in FIG. 4 are similar to those shown in FIG. 3 and again indicate a drop in through voltage with increasing thickness of the Cr-N layer. As expected, the absolute value of through voltage is greater when higher resistivity resistance layers are used, as indicated by the higher values of through voltage in the plots of FIG. 4, as contrasted with those in FIG. 3. However, both ribbons exhibited the same drop in through voltage with increasing thickness of the Cr-N layers.

Figure 5:
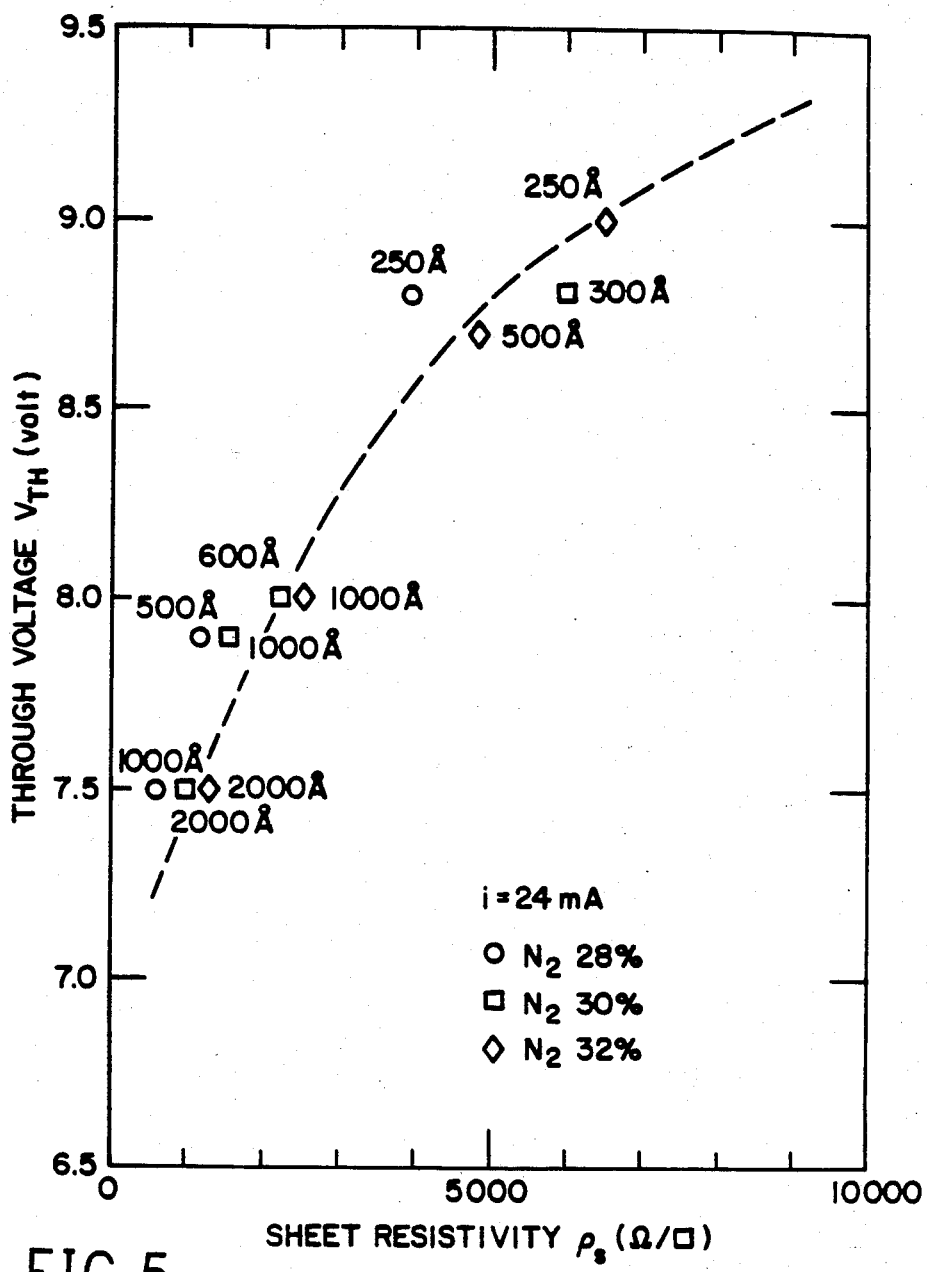
FIGS. 5 and 6 plot the through voltage versus sheet resistivity $\rho_s$ of coating layers comprised of Cr-N films. The ribbon used for the measurements depicted in FIG. 5 is the same as the ribbon used for the measurements depicted in FIG. 3, while the ribbon used for the measurements depicted in FIG. 6 is the same as that used for the measurements depicted in FIG. 4. Thus, the resistivity of the resistive layer of the ribbon used to make the measurements depicted in FIG. 6 has a higher resistivity than that of the resistive layer in the ribbon used to make the measurements depicted in FIG. 5.
Figure 6:
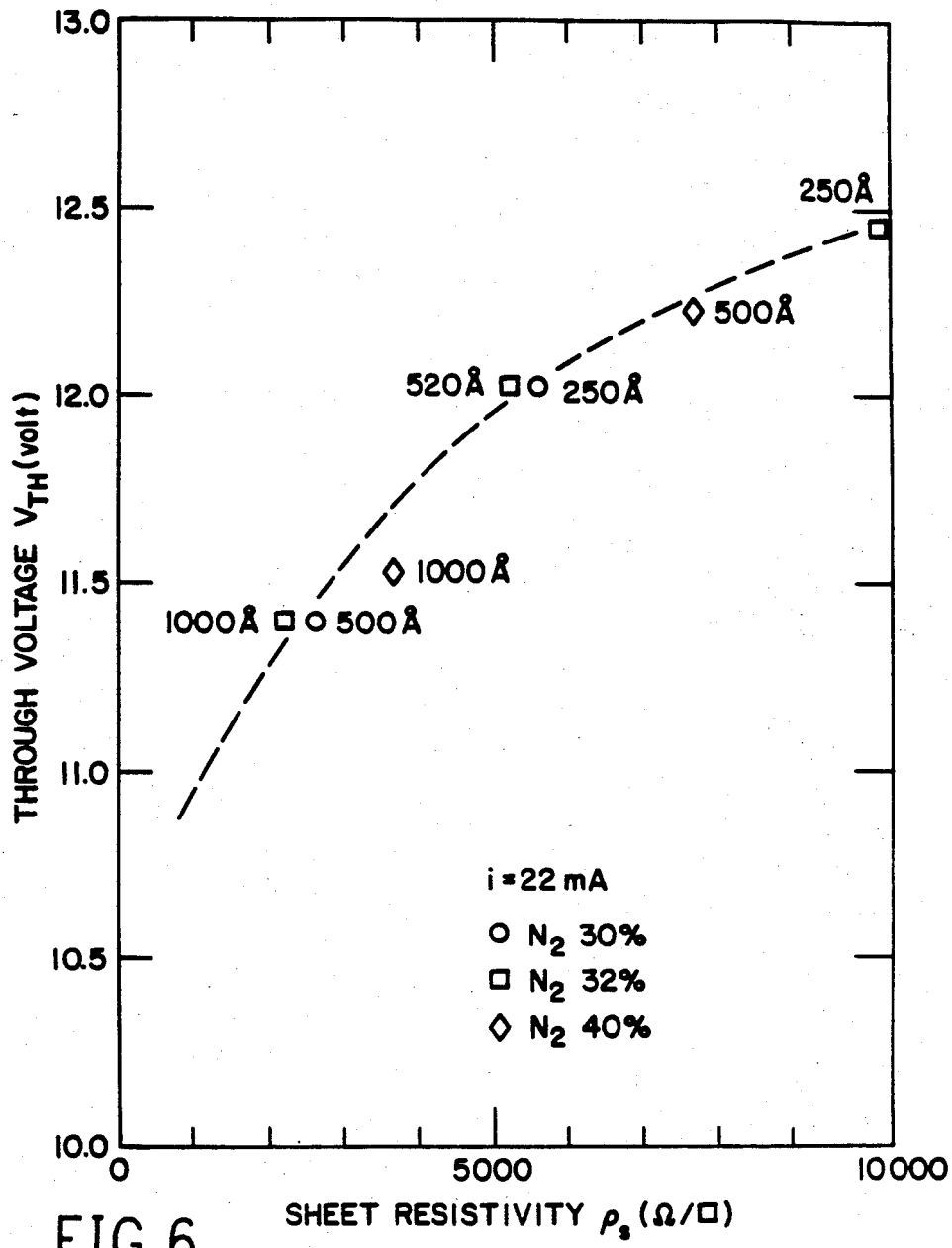

FIGS. 5 and 6 show the through voltage as a function of sheet resistivity of the Cr-N films, for the resistive ribbon described with respect to FIGS. 3 and 4. Thus, the resistive layer in the ribbon of FIG. 6 has a higher resistivity than the resistive layer in the ribbon of FIG. 5. It was found that, for Cr-N films having resistivities higher than about 5000 ohms/sq., only small gains in through voltage were obtained as the sheet resistivity increased. On the other hand, if the sheet resistivity of the coated films were less than about 1000 ohms/sq., the optical density of the printing was reduced at the same printing current, in comparison to a ribbon having no surface coating to reduce contact resistance. The best results were obtained when the sheet resistivity was in the range of about 2000–3000 ohms/sq. and the thickness of the Cr-N films was between about 500 and 1000 Angstroms. A reduction of through voltage between about 1.5 and 2.5 V was observed.

As an example, the printing sample using the ribbon of FIG. 5 (low resistivity resistance layer) having a 500 Angstroms thick Cr-N layer (nitrogen content 30% during sputtering) was compared to the printing sample of the same ribbon having no coating to reduce contact resistance. For printing at different levels, it was found that the printing quality of both ribbons was about equal at high currents. However, the coated ribbon is better at low printing currents. A through voltage for this coated ribbon is about 1.5 V lower than that for the uncoated ribbon, where the through voltage for the uncoated ribbon was about 9.5 V. This corresponds to about a 15% reduction of total printing power and maybe a 50% reduction of power at the contact of the ribbon and the electrode.

In the section to follow, more detail will be provided concerning a particular contact resistance-reducing coating, specifically Cr-N. These films (and also the other listed compositions) can be prepared by reactive d.c. sputtering and by hollow cathode electron beam evaporation processes, as can be seen by referring to Sikkens et al, Thin Solid Films, 108, p. 229 (1983) and S. Komiya et al, Journal of Vacuum Science Technology, 13, p. 520 (1976).

Films of Cr-N were deposited using an r.f. magnetron source. This system could be evacuated to less than $10^{-7}$ Torr by a turbo molecular pump prior to introduction of the gas mixture. Argon and nitrogen gases of very high purity were then introduced through flow meters and their ratios were measured. During the sputtering process, the total power was set at 1500 W and the total pressure was set at 20 microns. The substrates were not biased and were not heated or cooled intentionally.

After deposition, the thickness of the films were determined by a surface profilometer and sheet resistivities were determined by the four point probe method. The composition of the films were measured with an electron micro-probe, and the structure of the films was measured by the x-ray diffraction method.

Figure 7:
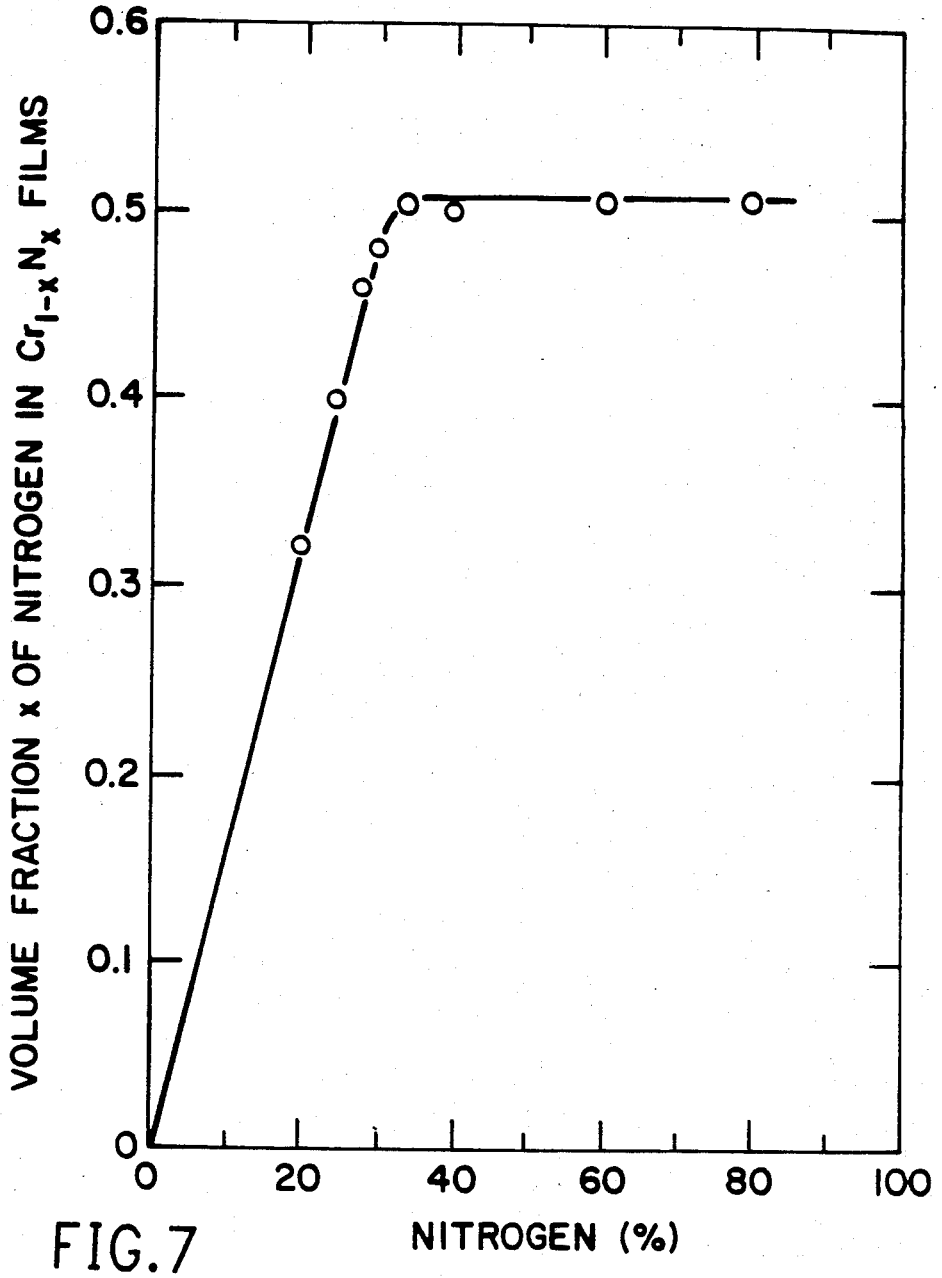
FIG. 7 is a plot showing the composition of Cr-N films versus nitrogen content in the sputtering gas mixture.

The composition of these Cr-N films as a function of nitrogen content in the sputtering gas mixture is shown in FIG. 7. The volume fraction x of nitrogen in Cr-N films is almost linearly proportional to the nitrogen content when its value in the sputtering mixture is less than 30%. For higher values, it remains constant at approximately 1:1 ratio (with slightly higher Cr content), independent of the nitrogen content in the sputtering gas mixture.

X-ray diffraction measurements indicated that, for films deposited with 20% nitrogen during sputtering, fairly broad polycrystalline lines were observed. The data showed the presence of both Cr and Cr-N. When a film was deposited with 30% nitrogen in the sputtering gas mixture, the diffraction peaks were much sharper and the films were polycrystalline in nature with a 111 fiber texture of Cr-N. Similar results were observed on samples with even higher nitrogen content. The surface morphology of these Cr-N films was examined with scanning electron microscopy. A distinct difference was noted between films deposited with lower nitrogen content in contrast with those deposited with higher nitrogen content. For films deposited with 20% nitrogen content, the surface of the Cr-N films was very smooth, while for films deposited with more than 30% nitrogen during sputtering the films exhibited a slightly dendritic texture.

As noted previously with respect to FIG. 2, the resistivity of these films initially increases with increasing nitrogen content in the sputtering mixture. When the nitrogen content is greater than 30% (partial pressure of nitrogen equals $6\times10^{-3}$ Torr), the resistivity is near its peak value and therefore it does not change very much with higher nitrogen content. These results were reproducibly obtained on either thin (1000 Angstroms) or thick (1 micron) Cr-N films.

As is apparent from these figures, Cr-N films can be reproducibly made using r.g. sputtering deposition. The resistivity values can be changed by three orders of magnitude by varying the nitrogen partial pressure during sputtering. The films can be divided into two categories, based on the structure and morphology measurements. One category is films made with nitrogen concentration of less than 30% during the deposition process. In this category, the films exhibit both Cr and Cr-N phases, so that their properties depend on the relative concentration of both phases. The other category is films made with nitrogen concentration above 30% during the deposition process. Films in this category have almost identical properties since they all have only one Cr-N phase. The transformation of getting rid of the excess Cr in the film is responsible for the sharp transition regions seen in FIGS. 2, and 7. The resistive properties of the films are quite constant for deposition with sufficient nitrogen content to form only the Cr-N phase.

The general principles described hereinabove can be applied to coatings of Sn-SnO, ITO, Al-N and Al-$Al_2O_3$, where the relative amounts of oxygen during the evaporation or sputtering process can be used to vary the resistivity of the coatings. The thickness and resistivity ranges for these materials are similar to those for the Cr-N coatings described in more detail hereinabove. For example, the sheet resistivity of these coatings will be in the range of about 1000–4000 ohms/sq., and their resistivities in the order of about $10^{-2}$ ohm-cm.

While the invention has been described with respect to particular embodiments thereof, it will be understood by those of skill in the art that variations can be made therein without departing from the spirit and scope of the present invention. For example, the thicknesses and resistivities of these coatings can be varied depending upon the design of the rest of the layers comprising the resistive ribbon. Thus, thicker coatings having different resistivities can be tailored to resistive ribbons using higher printing currents and/or multiple layers therein, such as resistive layers, current return layers, release layers, and ink layers. As long as the inequalities with respect to resistivity and sheet resistivity are followed, suitable coatings comprising these materials can be deposited.

Having thus described our invention, what we claim as new and desire to secure by Letters Patent is:

1. A resistive ribbon for thermal transfer printing, comprising:

an electrically conducting resistive layere through which electrical current can flow by electronic conduction from a printing electrode in contact with said ribbon to cause localized heating in said ribbon, a marking layer containing a marking material such as ink, said marking layer being melted when said localized heating occurs, and a conductive coating located on the printing electrodecontacting side of said resistive layer remote from said marking layer for reducing contact resistance between said printing electrode and said ribbon, said conductive coating being comprised of a material selected from the group consisting of Cr-N, Sn-SnO, indium tin oxide, Al-N and Al-$Al_2O_3$ and having a sheet resistivity greater than the sheet resistivity of said electrically conducting resistive layer.

2. The ribbon of claim 1, further including a thin conductive layer for electric current return located between said resistive layer and said marking layer.

3. The ribbon of claim 2, where said thin conductive layer is aluminum.

4. The ribbon of claim 1 where said conductive coating has a resistivity which is less than the resistivity of said resistive layer.

5. The ribbon of claim 4, where said conductive coating has a thickness between about 100 Angstroms and about 3000 Angstroms.

6. The ribbon of claim 5, where the resistivity of said conductive coating is the range of about 0.5 to 1 ohm-cm.

7. The ribbon of claim 1, where said resistive layer is a carbon-loaded polycarbonate layer.

8. The ribbon of claim 1, where said conductive coating is less than 1 micron in thickness and has a structure evidencing polycrystallinity.

9. A resistive ribbon for thermal transfer printing comprising:

an electrically conducting resistive layer through which electrical currents from printing electrodes flow to cause localized heating, a thin conductive current return layer located on one side of said resistive layer for conducting said electrical current, a marking layer containing a marking material that is meltable by said localized heating and transferable when melted to an adjacent carrier, and a conductive coating located on the printing electrodecontacting surface of said resistive layer opposite said thin conductive current return layer, said conductive coating having a resistivity less than that of said resistive layer, and a sheet resistivity greater than that of said resistive layer, said conductive coating being less than 1 micron thick and comprised of a material selected from the group consisting of Cr-N, Sn-SnO, indium tin oxide, Al-N and Al-$Al_2O_3$.

10. The ribbon of claim 9, wherein said resistive layer is comprised of a polymeric resin-binder filled with a conductive particulate filler.

11. The ribbon of claim 10, where said resin-binder is polycarbonate and said filler is carbon black.

12. The ribbon of claim 10, where said resin-binder is polyurethane and said filler is carbon black.

13. The ribbon of claim 9, where said thin conductive current return layer is aluminum.

14. The ribbon of claim 13, where said aluminum layer has a thickness in the order of about 1000 Angstroms.

15. The ribbon of claim 9, where said conductive coating is a material whose structure exhibits polycrystallinity and a fiber texture.

* * * * *